United States Patent [19]

Yokoya et al.

[11] Patent Number: 4,479,234

[45] Date of Patent: Oct. 23, 1984

[54] AM STEREOPHONIC DEMODULATING CIRCUIT

[75] Inventors: Satoshi Yokoya, Chofu; Norio Numata, Tokyo, both of Japan

[73] Assignee: Sony Corporation, Tokyo, Japan

[21] Appl. No.: 356,894

[22] Filed: Mar. 10, 1982

[30] Foreign Application Priority Data

Mar. 20, 1981 [JP] Japan ..... 56-41280

[51] Int. Cl.³ ..... H04H 5/00

[52] U.S. Cl. ..... 381/15

[58] Field of Search ..... 381/15, 11, 12, 16, 381/13; 455/213

[56] References Cited

FOREIGN PATENT DOCUMENTS

| | | |
|---|---|---|
| 946562 | 1/1964 | United Kingdom . |
| 1027539 | 4/1966 | United Kingdom . |
| 1033580 | 6/1966 | United Kingdom . |
| 1157674 | 7/1969 | United Kingdom . |
| 1157673 | 7/1969 | United Kingdom . |
| 2064277A | 6/1981 | United Kingdom . |

*Primary Examiner*—R. J. Hickey

*Attorney, Agent, or Firm*—Lewis H. Eslinger; Alvin Sinderbrand

[57] ABSTRACT

In a radio receiver including a demodulating circuit with monaural and stereophonic modes for respectively demodulating a monaural broadcast signal having a carrier amplitude modulated with a monaural signal and demodulating an AM stereophonic broadcast signal having a carrier modulated with the sum and difference of right- and left-channel stereophonic signals and with a relatively low frequency pilot signal, and a tuning section operable for tuning the receiver to receive a broadcast signal whose carrier has a selected frequency; a filter is effective to extract the pilot signal from the received broadcast signal when the latter is an AM stereophonic broadcast signal and the stereophonic mode of the demodulating circuit is established in response to the extracted pilot signal, a disturbance signal generated upon operation of the tuning section or in response to external noise and which is in a frequency range near to the frequency of the pilot signal so as to be possibly extracted with the latter, and thereby confused with the pilot signal for establishing the stereophonic mode, is separately detected, and establishment of the stereophonic mode is prevented, for example, by muting an output of the filter, in response to detection of the disturbance signal while a monaural broadcast signal is being received.

12 Claims, 11 Drawing Figures

MONAURAL MODE
STEREO MODE

Ex
Ex
Sp

Ex
Ex
Sp

Ed
Esp

Sx

Sm

Sh
t1
t2

AM STEREOPHONIC DEMODULATING CIRCUIT

BACKGROUND OF THE INVENTION

1. Field of the Invention

The present invention relates generally to a radio receiver and more particularly is directed to a receiver capable of demodulating either an AM stereophonic broadcast signal or a monaural broadcast signal.

2. Description of the Prior Art

It is known to provide a stereophonic broadcast in which only one AM broadcast wave is employed, for example, as disclosed in U.S. Pat. No. 4,194,088 in which a sum signal L+R of a left channel signal L and a right channel signal R is used to AM-modulate a carrier signal and a difference signal L−R is employed to phase-modulate the carrier signal. Further, the carrier signal is phase-modulated by a pilot signal Sp which indicates that broadcast is stereophonic. In such case, an AM broadcast wave Sb is expressed as follows:

$$Sb=(1+L+R)\cos\{\omega_c \cdot t+\alpha(L-R)+Sp\}$$

where $\omega_c$ is the carrier frequency (angular frequency);

$Sp=\beta\cos\omega_p \cdot t$ $\omega_p=2\cdot\pi\cdot fp$ fp is the pilot frequency (5 to 100 Hz); and $\alpha$ and $\beta$ are each a constant (modulation degree).

A prior art receiver which will receive an AM stereophonic broadcast signal according to such system, may, for example, have a demodulating circuit which includes an AM detector receiving the usual IF signal to derive therefrom a monaural signal when receiving a monaural broadcast signal and to derive therefrom the sum signal L+R when receiving a stereophonic broadcast signal, a matrix circuit having a first input receiving the output of the AM detector, and a sub-channel demodulator also receiving the IF signal and deriving therefrom the difference signal L−R and the pilot signal Sp when an AM stereophonic broadcast signal is being received, with such difference signal L−R being applied to a second input of the matrix circuit so that the latter will provide left and right stereophonic signals at respective outputs when an AM stereophonic broadcast signal is received. A mode selecting switch is interposed between the sub-channel demodulator and matrix circuit, and such switch is closed to establish the stereophonic mode of the receiver, in which case, the difference signal L−R is transmitted by the switch to the matrix circuit, or the switch may be opened for establishing the monaural mode of the receiver. Further, in the known receiver, the pilot signal appearing in the output of the sub-channel demodulator when a stereophonic broadcast signal is received is extracted from such output by a band-pass filter and is processed to provide a corresponding voltage which is compared with a reference voltage in a level comparator to provide a corresponding compared output for controlling the mode selecting switch. Generally, when the extracted pilot signal appears in the output of the bandpass filter, the corresponding voltage is at a level relative to the reference voltage to cause the compared output to close the switch and thereby establish the stereophonic mode. On the other hand, when a monaural broadcast signal is being received, so that no pilot signal can be extracted from the output of the sub-channel demodulator, corresponding voltage is at such a level relative to the reference voltage as to cause the compared output to open the switch for establishing the monaural mode of the receiver.

However, when the above described prior art receiver is being tuned or detuned, the frequency or phase of the IF signal is changed and the demodulating circuit cannot distinguish the frequency or phase change of the IF signal due to tuning and detuning from the pilot signal which is intended to identify the reception of a stereophonic broadcast signal. In other words, a disturbance signal caused by the frequency or phase change of the IF signal upon tuning or detuning or by external noise is of a frequency similar to that of the pilot signal so that it also appears in the output of the sub-channel demodulator and may be extracted therefrom by the bandpass filter intended to extract the pilot signal. Therefore, even in the absence of an extracted pilot signal due to the fact that a monaural broadcast signal is being received, the disturbance signal occurring in response to tuning or detuning, or in response to external noise, may be erroneously identified as a pilot signal to cause erroneous establishment of the stereophonic mode while a monaural broadcast signal is being received.

OBJECTS AND SUMMARY OF THE INVENTION

Accordingly, it is an object of the present invention to provide a radio receiver with a demodulating circuit having selectively established monaural and stereophonic modes, and which is free of the above-described disadvantages of the existing receivers of that type.

More specifically, it is an object of this invention to provide a radio receiver with a demodulating circuit having monaural and stereophonic modes, and in which change-over from one to the other of such modes is automatically effected without the possibility of error in dependence on the reception of a monaural broadcast signal or a stereophonic broadcast signal, respectively.

Another object of the invention is to provide a radio receiver with a demodulating circuit having monaural and stereophonic modes, as aforesaid, and in which the change-over from one to the other of such modes can be rapidly effected.

Still another object of the invention is to provide a radio receiver with a demodulating circuit having monaural and stereophonic modes, as aforesaid, and in which the energizing of an indicator or display for showing reception of a stereophonic broadcast signal can be rapidly effected upon the change-over of the demodulating circuit from its monaural mode to its stereophonic mode.

A further object of the invention is to provide a radio receiver with a demodulating circuit having a monaural mode for demodulating a monaural broadcast signal having a carrier amplitude modulated with a monaural signal, and a stereophonic mode for demodulating an AM stereophonic broadcast signal having a carrier modulated with the sum and difference of right- and left-channel stereophonic signals and with a relatively low frequency pilot signal, and in which the monaural and stereophonic modes of the demodulating circuit are reliably established in response to the absence and presence of the pilot signal, while surely avoiding erroneous establishment of the stereophonic mode in the event that a tuning or detuning operation of the receiver or external noise gives rise to a disturbance signal of a frequency similar to that of the pilot signal at a time when a monaural broadcast signal is being received.

In accordance with an aspect of this invention, in a radio receiver including a demodulating circuit having a monaural mode for demodulating a monaural broadcast signal having a carrier amplitude modulated with a monaural signal and a stereophonic mode for demodulating an AM stereophonic broadcast signal having a carrier modulated with the sum and difference of right- and left-channel stereophonic signals and with a relatively low frequency pilot signal, and a tuning section operable for tuning the receiver to receive a broadcast signal whose carrier has a selected frequency; there are further provided frequency responsive means for extracting the pilot signal from the received broadcast signal when the latter is an AM stereophonic broadcast signal, mode selecting means for establishing the stereophonic mode in response to the extracted pilot signal, means for detecting a disturbance signal generated upon operation of the tuning means or in response to external noise, and which is in a frequency range near to the frequency of the pilot signal so as to be possibly extracted with the latter by said frequency responsive means and thereby erroneously responded to by said mode selecting means, and means responsive to the detected disturbance signal when the received broadcast signal is a monaural signal for preventing erroneous establishment of the stereophonic mode by the mode selecting means.

In certain embodiments of this invention, the mode selecting means includes sampling and holding means, means for applying to the sampling and holding means a voltage characteristic of the output of the frequency responsive means and means for establishing the stereophonic mode when a voltage held by the sampling and holding means exceeds a predetermined level, and the means for preventing erroneous establishment of the stereophonic mode includes means responsive to the detected disturbance signal for operating the sampling and holding means to sample and hold the level of the voltage characteristic of the output of the frequency responsive means existing immediately before the occurrence of the detected disturbance signal.

In another embodiment of the invention, the means for preventing erroneous establishment of the stereophonic mode includes means for muting an output of the frequency responsive means, for example, through the collector-emitter path of a transistor which is made conductive to ground, in response to detection of the disturbance signal when receiving a monaural broadcast signal.

The above, and other objects, features and advantages of the present invention, will be apparent in the following detailed description thereof when read in conjunction with the accompanying drawings in which the same reference numerals designate corresponding parts in the various views.

DESCRIPTION OF THE PREFERRED EMBODIMENTS

Figure 1:
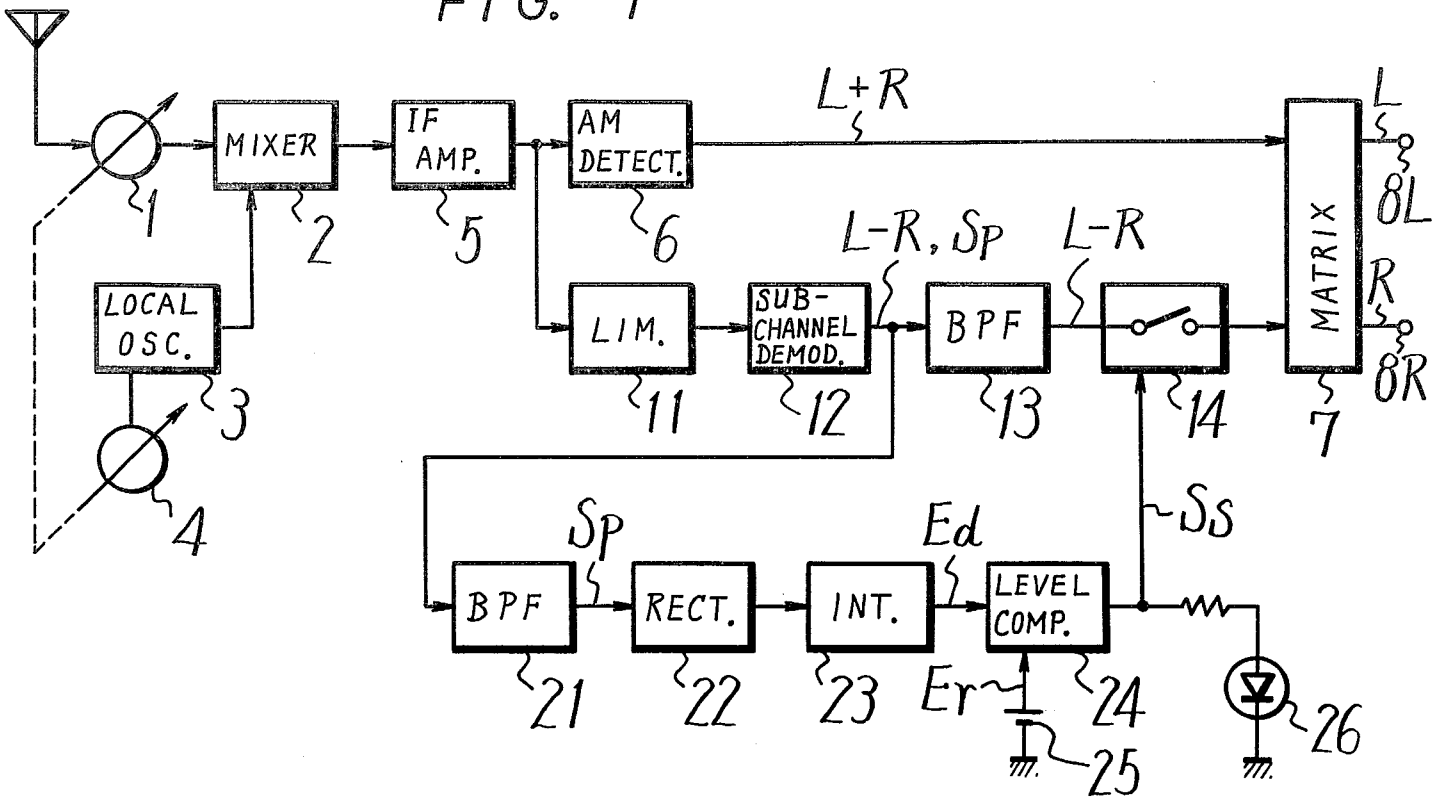
FIG. 1 is a schematic block diagram showing a receiver according to the prior art for selectively receiving an AM stereophonic broadcast signal or a monaural broadcast signal.

Before describing the present invention, the problem to be overcome thereby will be explained in detail with reference to a prior art receiver for receiving an AM stereophonic broadcast employing only one AM broadcast wave, and which, as shown on FIG. 1, comprises a high frequency (or radio frequency) tuning circuit 1 receiving the broadcast signal through an antenna and supplying its output signal to a mixer circuit 2 also receiving the output of a local oscillator 3 provided with a resonant circuit 4. The output from mixer circuit 2 is fed to an IF (intermediate frequency) amplifier 5 whose output is applied to an AM detecting circuit 6. From this AM detecting circuit 6 there is derived a monaural signal when receiving a monaural broadcast, or a sum signal L+R when receiving a stereophonic broadcast, which is then fed to a matrix circuit 7 having output terminals 8L and 8R.

The IF signal from IF amplifier 5 is also fed through a limiter 11 to a PLL (phase locked loop) or subchannel demodulator 12 by which the difference signal L−R and the pilot signal Sp are demodulated when a stereophonic broadcast is being received. These signals L−R and Sp are then applied to a band pass filter 13 through which difference signal L−R is derived. The difference signal L−R thus extracted is fed to matrix circuit 7 through a switch circuit 14 which is opened for muting, as will be described later. Accordingly, at output terminals 8L and 8R of matrix circuit 7, there are obtained either stereophonic signals L and R when receiving a stereophonic broadcast, or the monaural signal when receiving a monaural broadcast. Further, in the known circuit of FIG. 1, the difference signal L−R and the pilot signal Sp from demodulator or PLL 12 are supplied to a band pass filter 21 through which the pilot signal Sp is extracted. The pilot signal Sp is then fed to a rectifier circuit 22 and an integration circuit 23, in succession, to provide a DC voltage Ed which is fed to a level comparing circuit or amplifier 24 to which a reference voltage Er is also applied from a power supply source 25. Level comparator 24 provides a compared output signal Ss which is "1" in response to stereophonic broadcast wave reception ($Ed > Er$) or "0" in response to monaural broadcast wave reception ($Ed \leqq Er$). This compared output signal Ss is applied to a stereophonic indicator or display LED (light emission diode) 26 and also as a switch control signal to switch circuit 14. The switch circuit 14 is closed or turned ON when Ss="1" and opened or turned OFF when Ss="0". Therefore, automatic change-over of the stereophonic and monaural modes is carried out by way of switch circuit 14 as mentioned above and LED 26 is only lit to indicate stereophonic reception.

Generally, when tuning the receiver shown in FIG. 1, the receiving frequency is varied past the desired tuning point. For example, if the tuning operation starts with the initial receiving frequency below the desired receiving frequency, the receiving frequency is progressively increased until it passes the desired frequency and then the direction of change of the receiving frequency is reversed and the receiving frequency is reduced until it is precisely equal to the desired frequency. During such tuning and detuning operations, the frequency or phase of the IF signal from IF amplifier 5 is changed, and the known circuit cannot distinguish the frequency or phase change of the IF signal due to the tuning and detuning from that due to the pilot signal Sp. Therefore, the tuning and detuning operations may cause misoperation of the known circuit of FIG. 1 so that LED 26 is illuminated and/or switch circuit 14 is closed to establish the stereophonic receiving mode even though a monaural broadcast signal is being received, or so that LED 26 is extinguished and switch circuit 14 is opened, as for the monaural receiving mode, even though a stereophonic broadcast signal is actually being received.

The foregoing possibility of misoperation results from the fact that a voltage Ex (FIG. 3A) is derived from PLL or sub-channel demodulator 12 as a result of the noise due to the tuning or detuning operation, and the frequency of that voltage Ex is near to the frequency of pilot signal Sp so that the receiver of FIG. 1 cannot distinguish therebetween.

Although voltage Ex generated when the user turns a tuning knob (not shown) of the receiver has a frequency which is generally low and near to that of the pilot signal, the degree of modulation of the carrier by pilot signal Sp is small and constant so that the level of pilot signal Sp, as derived from sub-channel demodulator 12, may be reliably lower than a predetermined level. Therefore, any AC component in the output from sub-channel demodulator 12 which is low in frequency but has a level higher than the predetermined level, can be assumed to be the voltage Ex generated by turning the tuning knob. The foregoing assumption provides the basis for the avoidance of erroneous mode selection and erroneous stereophonic display operation in receivers according to this invention.

Figure 2:
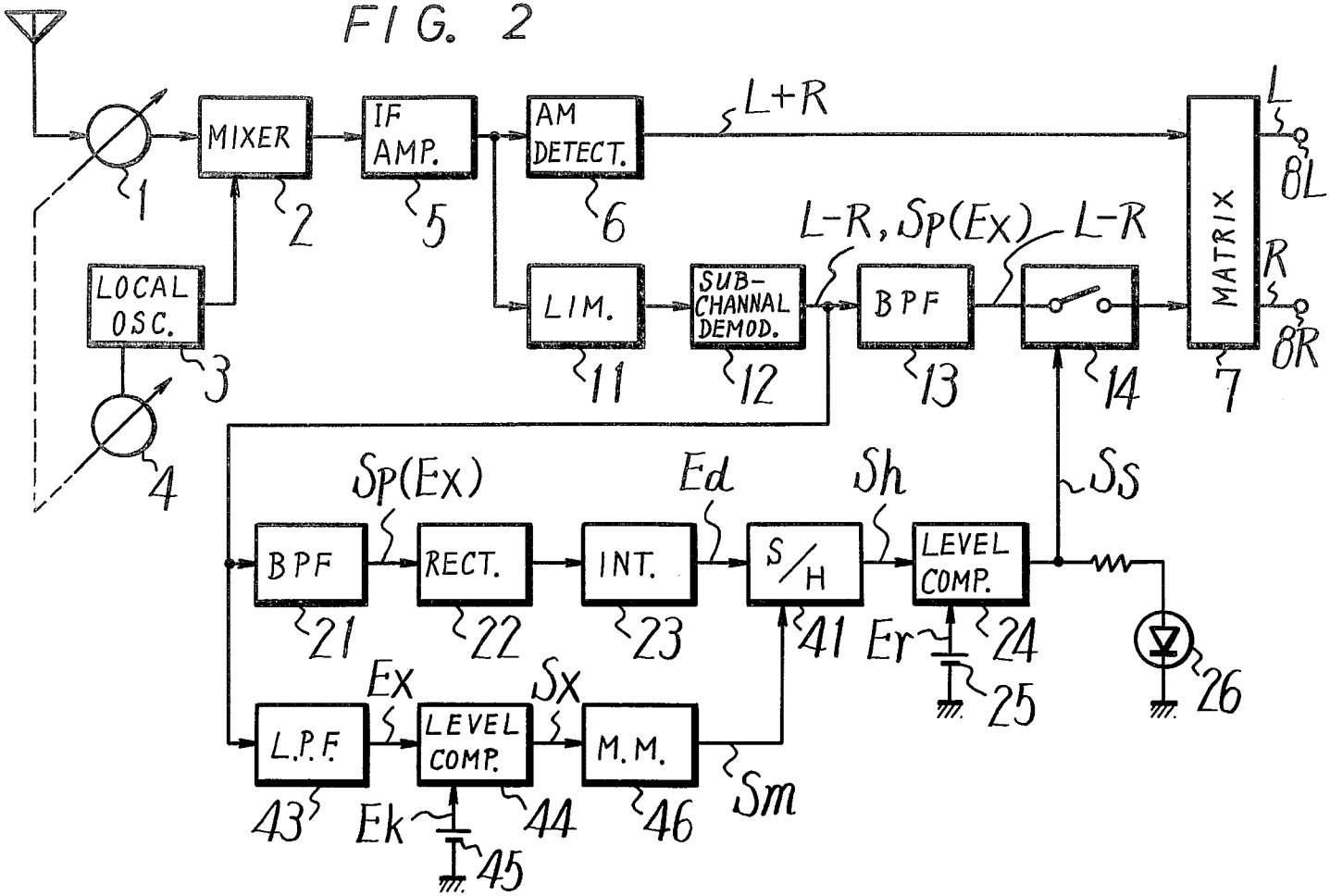
FIG. 2 is a schematic block diagram similar to that of FIG. 1, but showing a receiver according to a first embodiment of the present invention.

More particularly, reference to FIG. 2 will show that, in the embodiment of the invention there illustrated and in which, as earlier noted, parts and components corresponding to those described above with reference to FIG. 1 are identified by the same reference numerals, a sampling and holding circuit 41 is provided in the pilot signal line between integration circuit 23 and level comparator or amplifier 24. The sub-channel signal detected by and derived from sub-channel demodulator 12 has the waveform shown in FIG. 3B and is applied to band pass filter 21 whose center frequency is selected to be the frequency of pilot signal Sp. The signal passing through filter 21 is applied to rectifier 22 and then to integration circuit 23 so as to provide the signal Ed (FIG. 3C) to sampling and holding circuit 41.

Figures 3A, 3B, 3C, 3D, 3E, 3F:
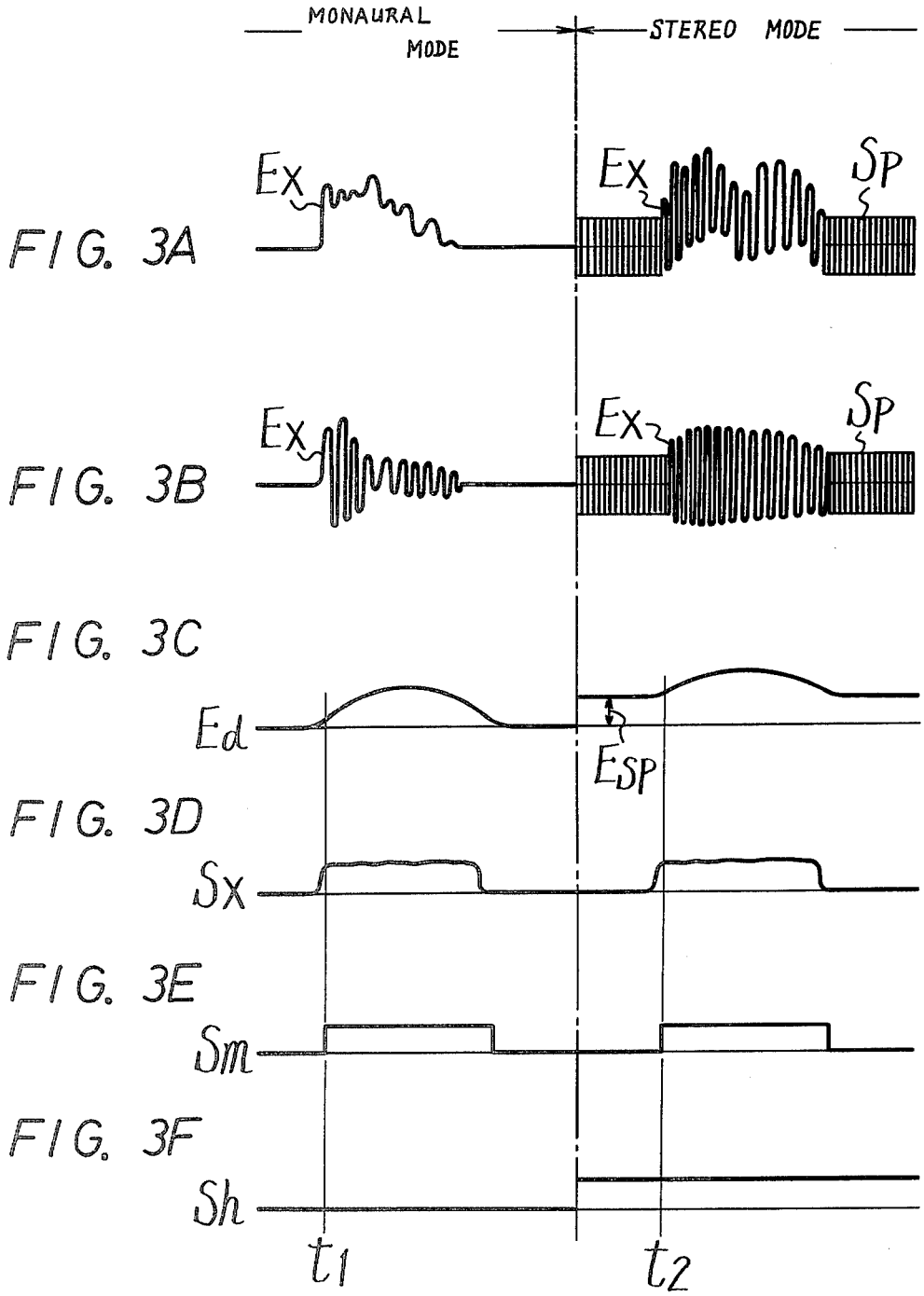
FIGS. 3A–3F are waveform diagrams to which reference will be made in explaining the operation of the receivers of FIGS. 1 and 2.

The output signal from sub-channel demodulator 12 is also applied to a low pass filter 43 from which the voltage Ex is mainly derived. This voltage Ex is applied to a level comparing circuit 44 which is also supplied from a power supply source 45 with a reference voltage Ek having a level corresponding to that of pilot signal Sp. From the level comparator 44 there is derived a compared output signal Sx which becomes "1" when voltage Ex exceeds the reference voltage Ek as shown in FIG. 3D. The compared output signal Sx is then applied to a monostable multivibrator 46 which produces a signal Sm having the value "1" for a predetermined period after each instance when the voltage Sx is made to be "1", as shown in FIG. 3E. This signal Sm is fed to the sampling and holding circuit 41 as a control or sampling signal so that sampling and holding circuit 41 produces an output signal Sh as shown in FIG. 3F. In other words, sampling and holding circuit 41 samples voltage Ed at each rising-up time of signal Sm. When receiving a monaural broadcast signal, voltage Ed is substantially of the zero level at the rising-up time $t_1$ (left-hand portion of FIG. 3D) and, therefore, sampling and holding circuit 41 holds this zero level in the period after time $t_1$ and delivers the output signal Sh at the zero level (FIG. 3F). In other words, even if a noise Ex is generated by an external disturbance when a monaural broadcast signal is being received (left-hand portion of FIG. 3B), the noise cannot be erroneously detected as the pilot signal Sp. Thus, the monaural signal reception mode is maintained by the circuit embodying this invention.

On the other hand, when a stereophonic broadcast signal is being received (right-hand portions of FIGS. 3A–3F), the voltage Ed is at the level Esp at the time $t_2$ when the signal Sm rises to the level "1" to cause sampling and holding circuit 41 to sample the voltage Ed and, therefore, circuit 41 samples and holds the level Esp for continuously delivering that level Esp as the signal Sh to level comparator 24. Therefore, so long as a stereophonic broadcast signal is being received, signal Sh is reliably delivered at the level Esp to the level comparator 24 so that the latter senses such level Esp as being greater than Er and, accordingly, provides compared output the value "1" for a predetermined period after each instance when the voltage Sx is made to be "1", as shown in FIG. 3E. This signal Sm is fed to the sampling and holding circuit 41 as a control or sampling signal so that sampling and holding circuit 41 produces an output signal Sh as shown in FIG. 3F. In other words, sampling and holding circuit 41 samples voltage Ed at each rising-up time $t_1$ of signal Sm. When receiving a monaural broadcast signal, voltage Ed is substantially of the zero level at the time $t_1$ (left-hand portion of FIG. 3D) and, therefore, sampling and holding circuit 41 holds this zero level in the period after time $t_1$ and delivers the output signal Sh at the zero level (FIG. 3F). In other words, even if a noise Ex is generated by an external disturbance when a monaural broadcast signal is being received (left-hand portion of FIG. 3B), the noise cannot be erroneously detected as the pilot signal Sp. Thus, the monaural signal reception mode is maintained by the circuit embodying this invention.

On the other hand, when a stereophonic broadcast signal is being received (right-hand portions of FIGS. 3A–3F), the voltage Ed is at the level Esp at the time $t_2$ when the signal Sm rises to the level "1" to cause sampling and holding circuit 41 to sample the voltage Ed and, therefore, circuit 41 samples and holds the level Esp for continuously delivering that level Esp as the signal Sh to level comparator 24. Therefore, so long as a stereophonic broadcast signal is being received, signal Sh is reliably delivered at the level Esp to the level comparator 24 so that the latter senses such level Esp as being greater than Er and, accordingly, provides compared output signal Ss with the value "1" for closing switch circuit 14 and igniting LED 26.

Even if the voltage Ex is generated due to tuning or detuning operations, the signal Sh applied from sampling and holding circuit 41 to level comparator 24 is held at the level Esp existing before the appearance of the voltage Ex. Thus, the mode changing switch 14 and the stereophonic display LED 26 cannot be erroneously operated. Owing to the fact that the mode changing switch 14 and stereophonic display LED 26 cannot be operated erroneously, in response to a tuning operation, the time constant of integration circuit 23 can be made short and, accordingly, mode changing switch 14 and stereophonic display LED 26 can be made to respond quickly to a change in the type of broadcast signal being received, for example, from a monaural broadcast signal to a stereophonic broadcast signal. Moreover, the circuit arrangement according to this invention avoids erroneous operation of mode changing switch 14 and LED 26 even if a voltage similar to that indicated at Ex on FIG. 3A is generated by an external noise wave or the like and does not result from a tuning or detuning operation.

Figure 4:
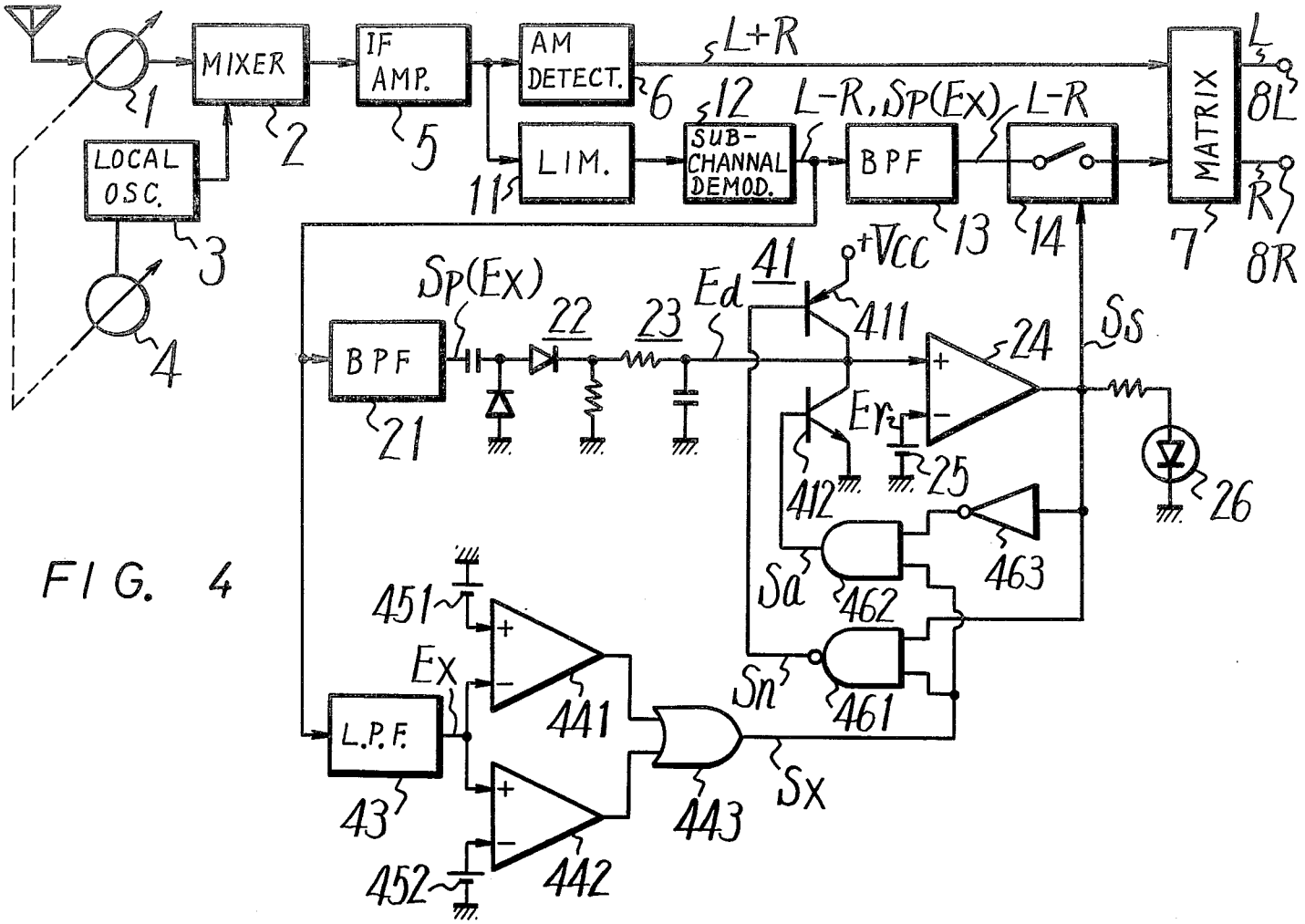
FIGS. 4, 5 and 6 are schematic block diagrams showing additional respective embodiments of the invention.

Referring now to FIG. 4, in which parts of the embodiment of the invention there illustrated which correspond to those shown on FIG. 1 or FIG. 2 are identified by the same reference numerals and will not be described again, it will be seen that two transistors 411 and 412 have their collector-emitter paths connected in series between a power supply source $+V_{cc}$ and the ground and the connection point therebetween is connected to the pilot signal line between integration circuit 23 and the comparing circuit or amplifier 24 to form sampling and holding circuit 41. The output from low pass filter 43 is fed to two level comparing circuits 441 and 442 which are supplied with reference voltages through power supply sources 451 and 452, respectively. The outputs from comparing circuits 441 and 442 are applied to an OR circuit 443, and the output from this OR circuit 443 is applied to a NAND circuit 461 and an AND circuit 462. The signal Ss from level comparing amplifier 24 is supplied to NAND circuit 461 and also through an inverter 463 to AND circuit 462. An output Sn from NAND circuit 461 is fed to the base of transistor 411, while an output Sa from AND circuit 462 is supplied to the base of transistor 412.

In the embodiment of the invention shown on FIG. 4, when the positive half cycle of the voltage Ex (FIG. 3B) from low pass filter 43 exceeds the reference voltage of power supply source 452, the output from comparing circuit 442 becomes "1". On the other hand, when the negative half cycle of the voltage Ex becomes lower than the reference voltage of power supply source 451, the output from comparing circuit 451 becomes "1". Thus, the signal Sx (FIG. 3D) is derived from OR circuit 443.

Upon the reception of a monaural broadcast signal, no pilot signal Sp is delivered, so that Ed=0 and Ss="0". If the voltage Ex is not produced, Sx="0" and hence Sa="0". Thus, transistor 412 is in its OFF-state, and due to signals Ss and Sx, Sn="1" so that transistor 411 is also in its OFF-state. Accordingly, the circuit of FIG. 4 is stable in this state, so that LED 26 is extinguished and switch circuit 14 is held in its open state by reason of Ss=0, and the circuit is maintained in the monaural mode.

With the circuit of FIG. 4 in the monaural mode, if voltage Ex is generated in response to a tuning or detuning operation or an external noise, Sx="1", Ss="0" and Sa="1", so that transistor 412 is turned ON. However, since Ss="0" and Sn="1", transistor 411 is maintained in its OFF state. Therefore, even if the generated voltage Ex would otherwise be likely to establish Ed>Er, the voltage Ed is shunted to ground through transistor 412 so that Ed="0" is maintained and Ss continues to be "0". As a result of the foregoing, if the voltage Ex is generated when the circuit of FIG. 4 is in its monaural mode, change-over of the circuit in its stereophonic mode and ignition of LED 26 are positively avoided.

On the other hand, if a stereophonic broadcast signal is received by the receiver of FIG. 4 at a time when the latter is in its monaural mode, the condition Ed>Er results from the presence of the pilot signal Sp. Assuming the absence of any voltage Ex due to a tuning or detuning operation, Sx="0" is maintained and, due to the monaural mode of the circuit, transistors 411 and 412 are both OFF. As a result, Ss="1" is obtained from level comparing amplifier 24 to effect illumination or ignition of LED 26 and the closing of switch circuit 14 for change-over of the receiver to its stereophonic mode. At this time, even though Ss="1", since Sx="0" due to the absence of the voltage Ex, Sn="1" and Sa="0" are both maintained and, hence, transistors 411 and 412 are held in the OFF state. Therefore, the receiver is stably maintained in its stereophonic mode.

With the receiver in its stereophonic mode, the appearance of the voltage Ex in response to a tuning or detuning operation or external noise results in Sx="1" and, due to the existence of Ss="1" and Sn="0", transistor 411 is turned ON. The ON state of transistor 411 ensures that the condition Ed>Er will be maintained to hold Ss="1". Therefore, even if the voltage Ex is generated with the receiver in its stereophonic mode, there is no chance that the receiver will be changed-over to its monaural mode, or that the LED 26 will be extinguished so long as a stereophonic broadcast is being received.

If a monaural broadcast signal is received with the receiver in its stereophonic mode, both Ed="0" and Sx="0" are established, with the result that the output of level comparing amplifier 24 becomes Ss="0", whereby switch circuit 14 is opened to establish the monaural mode and LED 26 is extinguished.

Figure 5:
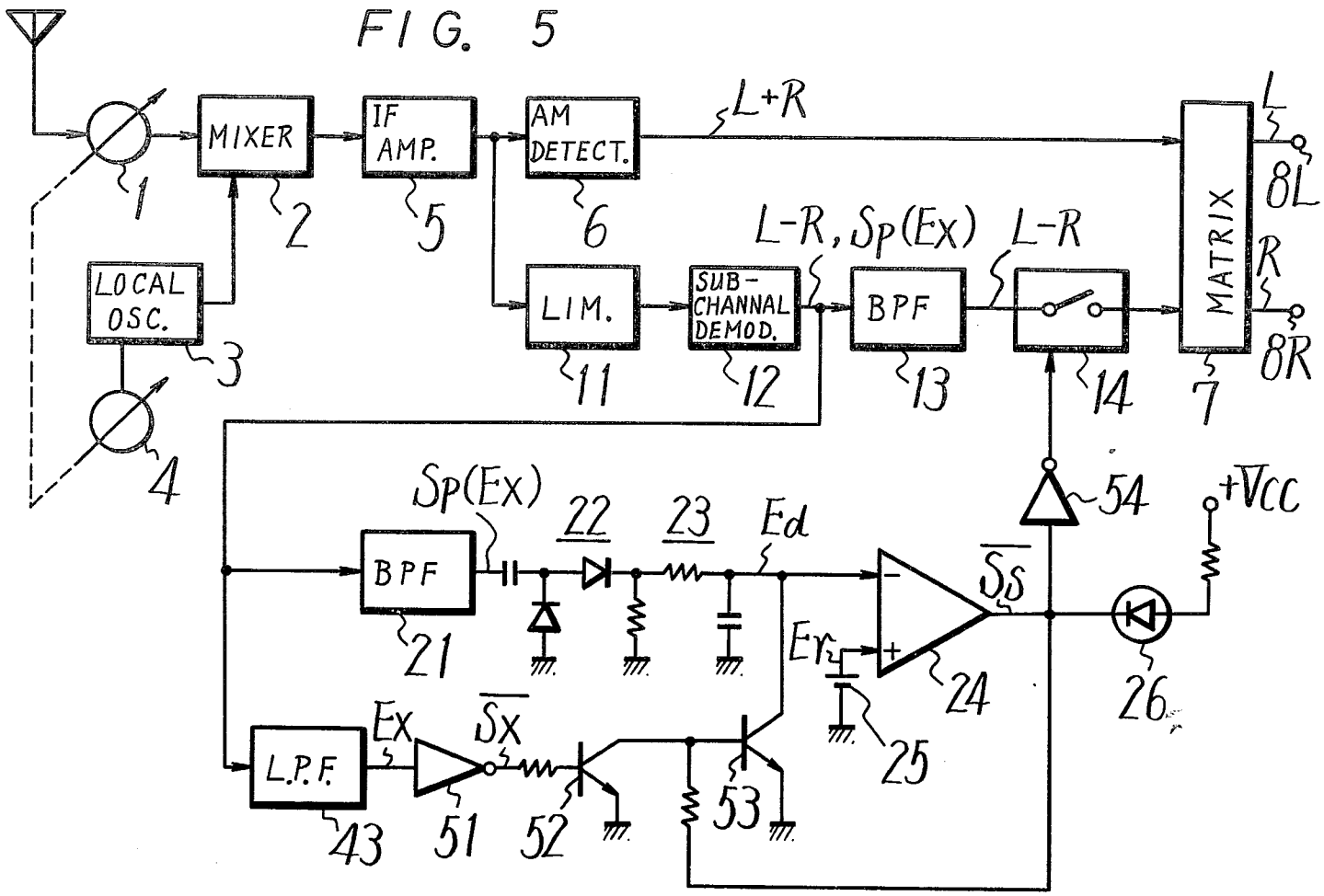

Referring now to FIG. 5, in which parts corresponding to those described above with reference to FIG. 4 are identified by the same reference numerals and will not be again described herein, it will be seen that, in the embodiment of FIG. 5, the output Ed of integrator 23 is applied to the negative input of level comparing amplifier 24 while the positive input of the latter receives the reference voltage Er from power supply source 25. Further, the output of low pass filter 43 is connected through an inverter 51 to the base of a transistor 52 which has its emitter connected to ground while its collector is connected to receive the output $\overline{Ss}$ of amplifier 24. The collector of transistor 52 is also connected to the base of a transistor 53 having its collector-emitter path connected between the output of integrator 23 and ground. The output of level comparing amplifier 24 is also connected through an inverter 54 to switch circuit 14 for controlling the latter, and LED 26 is connected between a voltage source $+V_{cc}$ and the output of amplifier 24.

In the circuit according to the embodiment of this invention shown on FIG. 5, when no voltage Ex is generated in response to a tuning or detuning operation or the like, $\overline{Sx}$="1" is obtained at the output of inverter 51 so that transistor 52 is turned ON and thereby maintains transistor 53 in its OFF state. When a stereophonic broadcast signal is received, since Ed>Er, the output of level comparing amplifier 24 becomes $\overline{Ss}$="0" so that LED 26 is ignited and, by reason of inverter 54, switch circuit 14 is closed to establish the stereophonic mode of the receiver circuit. On the other hand, when a monaural broadcast signal is being received, Ed="0" so that the output of amplifier 24 becomes $\overline{Ss}$="1" to extinguish LED 26 and, by reason of inverter 54, to change-over switch circuit 14 to its opened state for establishing the monaural mode of the receiver.

If the voltage Ex is generated at a time when the receiver is in its monaural mode, $\overline{Sx}$="0" so that transistor 52 is turned OFF, but transistor 53 is turned ON in response to $\overline{Ss}$="1" so that Ed="0" and, hence, cannot be greater than Er. As a result of the foregoing, LED 26 is positively maintained in its extinguished condition and switch circuit 14 is positively maintained in its opened state so as to avoid any change of the receiver from its monaural mode to its stereophonic mode.

Figure 6:
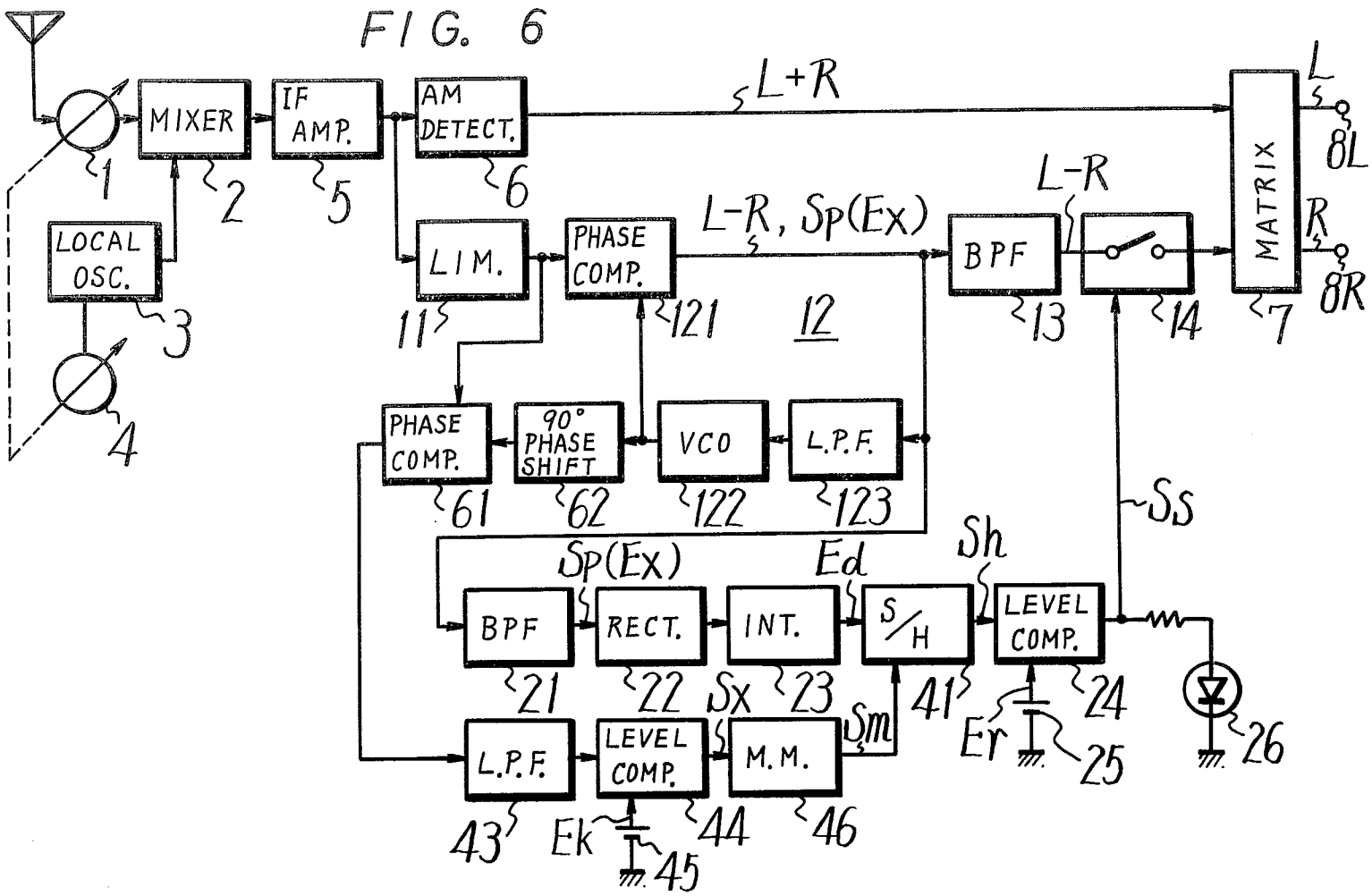

Referring now to FIG. 6, in which the various components corresponding to those described above with reference to FIG. 2 are identified by the same reference numerals, it will be seen that the signal Sx for triggering the monostable multivibrator 46 is there obtained at the output of level comparator 44 only when an output of PLL or sub-channel demodulator 12 indicates that a tuning or detuning operation is occurring. More particularly, in the embodiment of FIG. 6, PLL 12 is shown to be comprised of a phase comparator 121, a voltage controlled oscillator (VCO) 122 and a low-pass filter 123. The IF signal from IF amplifier 5 which passes through limiter 11 is applied to one input of phase comparator 121 which receives the output of VCO 122 at its other input. The output of phase comparator 121 is connected to band pass filter 13 for delivering the signals L−R and Sp to the latter. The output of phase comparator 121 is further applied to low-pass filter 123 and the output of the latter is applied to VCO 122 as the control voltage for the latter. The IF signal from IF amplifier 5 which passes through limiter 11 is also applied to one input of a phase comparator 61 which, at its other input, receives the oscillation output of VCO 122 after passage through a 90° phase shifter 62. The compared output of phase comparator 61 is then applied to low-pass filter 43 so that the output of the latter may be compared in level comparator 44 with the reference voltage Ek.

It will be appreciated that, so long as the tuning section of the embodiment of the invention shown on FIG. 6 is in its stationary state so as to receive a broadcast signal of a particular frequency, PLL 12 is locked to the IF signal so that phase comparator 61 generates no output. However, in response to a tuning or detuning operation, PLL 12 becomes unlocked and, as a result thereof, phase comparator 61 provides an output representing the voltage Ex which, when greater than the reference voltage Ek, causes the output Sx of comparator 44 to become "1". Thereafter, the operations of the embodiment shown on FIG. 6 are similar to those described above with reference to the embodiment of FIG. 2.

Although the invention has been described above as being applied to the reception of an AM stereophonic broadcast wave or signal having its carrier signal AM-modulated by the sum signal L+R, and phase-modulated by the difference signal L−R and also by the pilot signal Sp, the invention can be applied with the same advantageous results to other types of broadcast stereophonic signals in which any one or combination of AM-modulation, phase-modulation and frequency-modulation is selected for the modulation of the carrier signal by the sum signal L+R, the difference signal L−R and the pilot signal Sp, respectively.

Further, although illustrative embodiments of this invention have been described in detail herein with reference to the accompanying drawings, it will be understood that the invention is not limited to those precise embodiments, and that various changes and modifications may be effected therein by one skilled in the art without departing from the scope or spirit of the invention as defined in the appended claims.

What is claimed is:

1. A radio receiver having monaural and stereophonic modes for respectively demodulating a monaural broadcast signal having a carrier modulated with a monaural signal and demodulating an AM stereophonic broadcast signal having a carrier modulated with the sum and difference of left and right channel stereophonic signals and with a relatively low frequency pilot signal, comprising:

tuning means operable for tuning the receiver to receive a broadcast signal with a carrier of a selected frequency;

frequency responsive means for extracting said pilot signal from the received broadcast signal when the latter is an AM stereophonic broadcast signal;

mode selecting means for establishing said stereophonic mode in response to the extracted pilot signal, said mode selecting means including sampling and holding means, means for applying to said sampling and holding means a voltage characteristic of the output of said frequency responsive means, and means for establishing said stereophonic mode when a voltage held by said sampling and holding means exceeds a predetermined level;

means for detecting a disturbance signal generated at least upon operation of said tuning means and which is in a frequency range near to said frequency of the pilot signal so as to be possibly extracted with the latter by said frequency responsive means and thereby erroneously responded to by said mode selecting means; and means responsive to the detected disturbance signal when the received broadcast signal is a monaural signal for preventing erroneous establishment of said stereophonic mode by said mode selecting means, including means responsive to the detected disturbance signal for operating said sampling and holding means to sample and hold the level of said voltage characteristic of said output of the frequency responsive means existing immediately before the occurrence of said detected disturbance signal.

2. A radio receiver according to claim 1; further comprising demodulating means for demodulating said difference and pilot signals and having a phase locked loop which is in a phase-locked state when said tuning means is disposed to receive a broadcast signal with a carrier of a fixed frequency, and which is in an unlocked state when said tuning means is operated to change the carrier frequency of the broadcast signal to be received; and in which said means for detecting a disturbance signal includes means responsive to said unlocked state of the phase locked loop for generating said disturbance signal.

3. A radio receiver according to claim 2; in which said phase-locked loop includes a voltage controlled oscillator, a first phase comparator comparing an oscillation output of said oscillator with an intermediate frequency signal from said tuning means, and low pass filter means through which a compared output from said first phase comparator is applied as a control voltage to said voltage controlled oscillator; and in which said means for generating the disturbance signal includes a phase shifter for shifting the phase of said oscillation output, and a second phase comparator comparing the phase shifted oscillation output of said voltage controlled oscillator with said intermediate frequency signal and providing said disturbance signal as a compared output from said second phase comparator.

4. A radio receiver according to claim 1; in which said means responsive to the disturbance signal for operating said sampling and holding means includes low pass filter means for passing frequencies characteristic of said disturbance signal, level comparing means for comparing the output of said low pass filter means with a predetermined level, and pulse forming means responsive to an output of said level comparing means when said output of the low pass filter means exceeds said predetermined level for providing a sampling pulse at the onset of which said sampling and holding means is operated.

5. A radio receiver according to claim 1; further comprising AM detecting means for detecting a monaural signal when a monaural broadcast signal is received and the sum signal when an AM stereophonic broadcast signal is received, sub-channel demodulating means for detecting the difference signal and the pilot signal when the AM stereophonic broadcast signal is received, and matrix means having a first input connected to said AM detecting means and a second input for receiving said difference signal to provide left and right stereophonic signals at left and right outputs, respectively, of said matrix means; and in which said mode selecting means includes switch means interposed between said sub-channel demodulating means and said second input of the matrix means and being closed to establish said stereophonic mode.

6. A radio receiver according to claim 5; further comprising indicating means operated simultaneously with closing of said switch means for indicating the establishment of said stereophonic mode.

7. A radio receiver according to claim 5; in which said switch means is normally open and is closed in response to application of a control signal thereto, and a voltage level comparator receives said voltage held by the sampling and holding means and a reference voltage at said predetermined level and provides said control signal to said switch means when said held voltage exceeds said reference voltage.

8. A radio receiver according to claim 1; in which said means for detecting a disturbance signal includes low pass filter means for passing the disturbance signal, first and second level comparing circuits receiving the output of said low pass filter means and providing first and second compared outputs, respectively, when the positive and negative half-cycles of said disturbance signal exceed first and second reference voltages, respectively, and OR means providing an output in response to one of said first and second compared outputs for indicating detection of said disturbance signal.

9. A radio receiver according to claim 8; in which said sampling and holding mean includes first and second transistors having respective collector-emitter paths connected in series with each other between a power supply source and ground, and a connection point between said collector-emitter paths receiving said voltage characteristic of said output of the frequency responsive means; said means for establishing said stereophonic mode includes a level comparing amplifier having a first input connected to said connection point and a second input receiving a reference voltage of said predetermined level to provide a third compared output when a voltage at said connection point exceeds said reference voltage, and switch means closed in response to said third compared output to establish said stereophonic mode; and said means for operating the sampling and holding means includes NAND means having first and second inputs connected to the output of said OR means and the output of said level comparing amplifier and an output connected to the base of said first transistor, AND means having a first input connected to said output of the OR means, an output connected to the base of said second transistor and a second input, and an inverter through which said output of the level comparing amplifier is connected to said second input of said AND means.

10. A radio receiver having monaural and stereophonic modes for respectively demodulating a monaural broadcast signal having a carrier modulated with a monaural signal and demodulating an AM stereophonic broadcast signal having a carrier modulated with the sum and difference of left and right channel stereophonic signals and with a relatively low frequency pilot signal, comprising:

tuning means operable for tuning the receiver to receive a broadcast signal with a carrier of a selected frequency;

frequency responsive means for extracting said pilot signal from the received broadcast signal when the latter is an AM stereophonic broadcast signal;

mode selecting means for establishing said stereophonic mode in response to the extracted pilot signal;

means for detecting a disturbance signal generated at least upon operation of said tuning means and which is in a frequency range near to said frequency of the pilot signal so as to be possibly extracted with the latter by said frequency responsive means and thereby erroneously responded to by said mode selecting means;

means responsive to the detected disturbance signal when the received broadcast signal is a monaural signal for preventing erroneous establishment of said stereophonic mode by said mode selecting means;

AM detecting means for detecting a monaural signal when a monaural broadcast signal is received and the sum signal when an AM stereophonic broadcast signal is received;

sub-channel demodulating means for detecting the difference signal and the pilot signal when an AM stereophonic broadcast signal is received, matrix means having a first input connected to said AM detecting means and a second input for receiving said difference signal to provide left and right stereophonic signals at left and right outputs, respectively, of said matrix means; and in which said mode selecting means includes voltage controlled switch means interposed between said sub-channel de-modulating means and said second input of the matrix means and being closed to establish said stereophonic mode, means for providing a voltage characteristic of said extracted pilot signal, level comparator means having first and second inputs receiving said voltage characteristic of the extracted pilot signal and a reference voltage, respectively, and a compared output, and means connecting said compared output to said switch means as a control voltage for the latter; and further in which said means for preventing erroneous establishment of the stereophonic mode includes a first transistor having a collector-emmitter path connected to ground from said means for providing a voltage characteristic of the extracted pilot signal and a base connected to said compared output of the level comparator means for turning ON said first transistor when said compared output is effective to open said switch means for establishing said monaural mode, a second transistor having a collector-emitter path connected to ground from said base of the first transistor and a base, and means for applying said detected disturbance signal to said base of the second transistor for turning OFF the latter in response to the detection of said disturbance signal.

11. A radio receiver according to claim 10; in which said means for applying the detected disturbance signal to said base of the second transistor includes a first inverter, said compared output is an inverted output of said level comparator means, and a second inverter connects said inverted output to said switch means.

12. A radio receiver according to claim 11; further comprising indicating means connected between a voltage supply terminal and said inverted output of the level comparator means so as to be operated simultaneously with closing of said switch means for indicating establishment of said stereophonic mode.

* * * * *